United States Patent [19]

Lopata et al.

[11] 4,397,541

[45] Aug. 9, 1983

[54] METHOD AND APPARATUS FOR TRANSPORTING AN ELECTROSTATIC STRIP

[75] Inventors: Ira Lopata, New York, N.Y.; Robert M. Barto, Jr., Wyckoff, N.J.

[73] Assignee: Ragen Precision Industries, Inc., North Arlington, N.J.

[21] Appl. No.: 256,808

[22] Filed: Apr. 23, 1981

[51] Int. Cl.[3] ..... G03G 15/00

[52] U.S. Cl. ..... 355/14 SH; 355/3 R; 355/3 SH; 271/226

[58] Field of Search ..... 355/3 R, 3 BE, 15, 16, 355/50, 8, 75, 5, 12, 3 SH, 14 SH; 427/22; 346/161, 110 R; 430/31; 271/109, 38, 226

[56] References Cited

U.S. PATENT DOCUMENTS

| | | | |
|---|---|---|---|
| 3,473,035 | 10/1969 | Gardner et al. | 355/3 SH X |
| 4,185,760 | 1/1980 | McNew | 355/3 SH |
| 4,284,270 | 8/1981 | Silverberg | 271/98 X |
| 4,285,295 | 8/1981 | Iwao et al. | 355/3 FU X |
| 4,286,863 | 9/1981 | Cornwall et al. | 355/3 FU |
| 4,299,381 | 11/1981 | Smith | 271/98 X |
| 4,316,719 | 2/1982 | Motomura et al. | 355/3 FU X |
| 4,322,155 | 3/1982 | Lopata | 355/3 R |

*Primary Examiner*—A. C. Prescott

*Attorney, Agent, or Firm*—Daniel H. Bobis; David A. Jackson

[57] ABSTRACT

The method of transporting an electrostatic strip wherein the strip on a supply roll is pulled from the supply roll which is normally freely rotatable and the strip having been pulled from the supply roll is returnable to the supply roll by driving the supply roll in reverse to rewind the electrostatic strip; the unspooling of the electrostatic strip from the supply roll is performed by a pair of feed rollers; after imaging the electrostatic strip, it is carried between a pair of longitudinally ribbed guides past a magnetic toner to an inspection station at which station it may be viewed and optionally severed from the remainder of the electrostatic strip, which remainder is returned toward the supply roll for neutralization, detoning, reimaging and refeeding to the viewing station, while the portion of the electrostatic strip at the viewing station is carried in a generally horizontal planar course to a fuser for making permanent the toned, unfused electrostatic image.

5 Claims, 4 Drawing Figures

METHOD AND APPARATUS FOR TRANSPORTING AN ELECTROSTATIC STRIP

RELATED APPLICATIONS

This application is related to the several pending applications of Ira Lopata, sole inventor, Ser. No. 899,561, filed on Apr. 24, 1978, now abandoned; Ser. No. 007,699, filed on Jan. 30, 1979, now U.S. Pat. No 4,355,955 and Ser. No. 105,944, filed on Dec. 20, 1979, now U.S. Pat. No. 4,322,155.

BACKGROUND OF INVENTION

1. Field of Invention

This invention relates generally to methods and apparatus for transporting an electrostatic strip and particularly for enabling the user to reject a toned, unfused electrostatic image and reuse the electrostatic strip after detoning it and retoning it, or in the alternative, making permanent the electrostatic image on the electrostatic strip by fusing it.

2. Prior Art

With the general availability of information retrieval systems that place literally millions of bits of information at the fingertips of the user, it has been found desirable to present for inspection, various bits of information withdrawn from the system. Thus the system may present a whole series of bits of information, some of which in the series are relevant and some of which are irrelevant to the user's inquiry. The user of the system should have the right to reject the irrelevant bits of information and select the relevant bits of information for hard copy. Existing systems seeking to accomplish such results usually only provide for the creation of hard permanent copies, or if providing an inspection station appear to contemplate the possibility of making erasures, changes or corrections at an inspection station before converting the imaged electrostatic strip into a hard copy. The present invention provides either a permanent copy, or an erasure of an unfused copy, and making the erased electrostatic strip available for reuse.

SUMMARY OF INVENTION

The purpose of the invention which is the subject of the present specification is not to enable changes, alterations or corrections, but to:

a. First to permit detailed and exhaustive examination of a toned, unfused electrostatic image to determine whether it in total, presents useful information;

b. Then to enable the conversion of the toned, unfused electrostatic image into a hard permanent copy; or c. Totally erasing the toned, unfused electrostatic image which does not contain useful information by returning the electrostatic strip to the supply roll after totally neutralizing the electrostatic image and detoning it so that the electrostatic strip may once more be imaged and toned before again being moved to the inspection station with a new image thereon for evaluation.

This is accomplished by providing a paper supply roll and feed rollers to deliver the paper supply to be guided past a conditioning lamp, past positive and negative corona chargers, and then past an electrostatic imaging device in proximity to its face wherein a preselected image called from a library of information is applied to the strip. Thereafter, the strip is led past a magnetic toner, past an inactive neutralizing lamp and an inactive cutter to an inspection station where the strip pauses for viewing and either acceptance or rejection. Conveyor belts which are slotted to admit the air flow, attract the electrostatic strip to the belts by partial vacuum and carry the strip to the inspection station where the driven rollers pause to permit the belts to hold the electrostatic strip for inspection. If inspection discloses the information as that which is sought, the pertinent area of the strip is severed and the belts then carry the electrostatic strip to the fusers where the toner powder is fused thereon. The position, and attitude of the electrostatic strip from the inspection station to the fuser is generally horizontal and planar in order that the toner powder attracted to the electrostatic image on the electrostatic strip shall not be disturbed and moved from the image configuration. The fuser is in close proximity to the inspection station and substantially positioned at the end of the horizontal planar courses of the belts. Thus, before the toner powder is disturbed from registration with the electrostatic image and while it is gravitationally held in image configuration, it passes between the fusers and is made into a permanent image. The influence of gravity on the toner powder as well as the influence of the electrostatic image on the toner powder are both sufficient to maintain the toner in true registration with the image configuration applied to the electrostatic strip. Since the electrostatic image at the inspection station is subjected to ambient light for the purposes of visual inspection to determine its acceptance or rejection, the image may be discharged in whole or in part by ambient light dependent upon the period of inspection and the quality and strength of the ambient light. Should this be the case, the gravitational forces exerted upon the toner powder are sufficient to maintain the toner powder in precise image configuration without substantially fuzziness in the toned, unfused powder constituting the image. If, on the other hand, the image at the inspection station is rejected, the supply roll is powered to recall the electrostatic strip and at the same time a neutralizing light is activated which fully neutralizes the electrostatic charge and the magnetic toner, before which the toned, unfused electrostatic image on the strip passes, detones the electrostatic strip for reuse, leaving it completely blank of electrostatic image. Upon passing a conditioning lamp, the electrostatic strip is restored to substantially virgin, unimaged quality so that the cycle may be repeated. By this means, an apparatus is presented by which information may be called up from a repository of such information and presented in black on white readable form. It may be accepted or rejected and no hard copies are wastefully made but the viewer may select information presented by reading it as if in ordinary print, black on white, rather than be required to examine such information as is sometimes presented by a glowing screen with an eye fatiguing green image.

THE DRAWINGS

These objects and advantages as well as other objects and advantages may be attained by the device and method shown by way of illustration in the drawings in which.

PREFERRED EMBODIMENT

Figure 1:
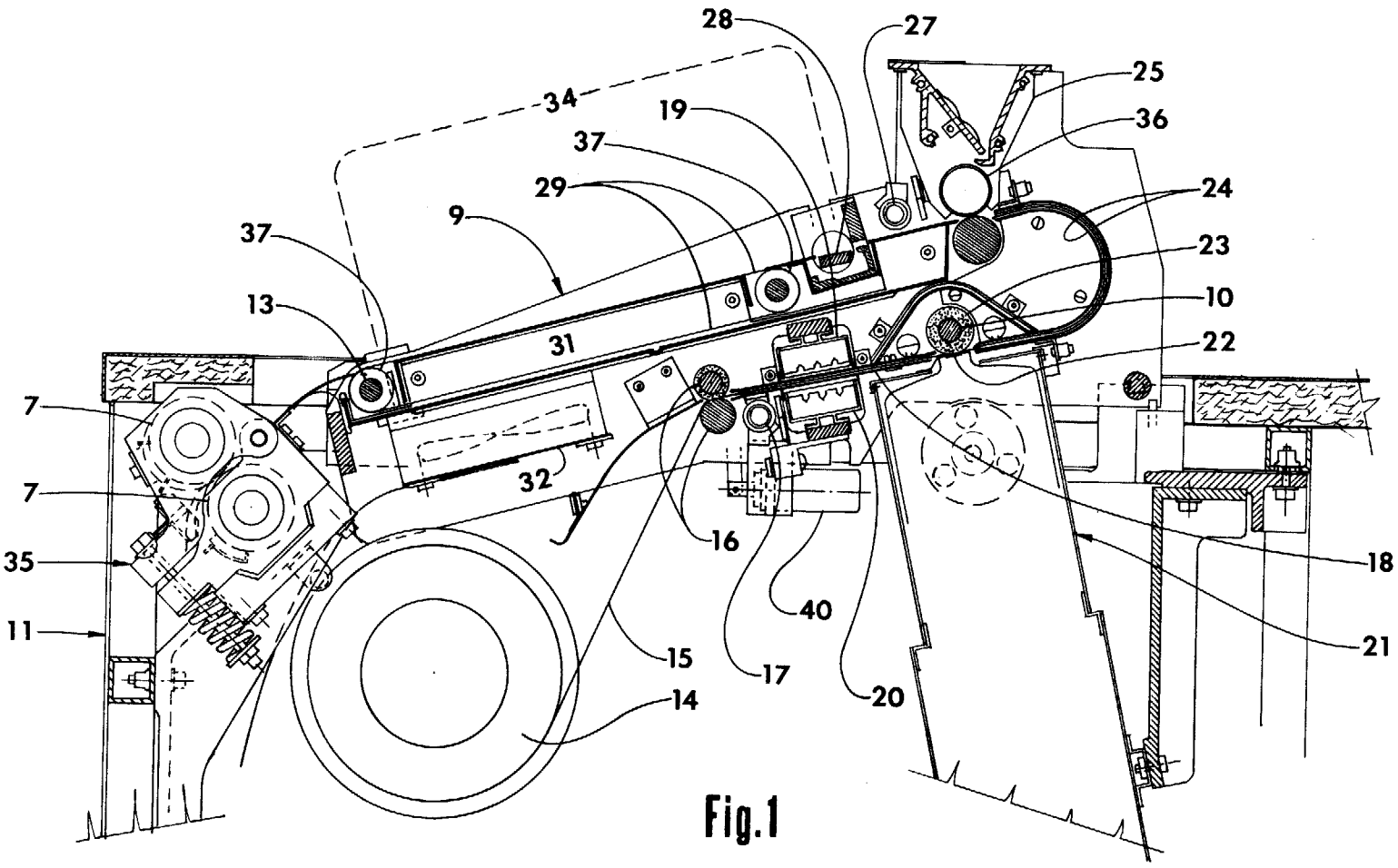
FIG. 1 is a right side elevational view partially in vertical section of an apparatus showing one preferred form of transport system for an electrostatic strip including the unique guide means in operative association therewith for turning the electrostatic strip towards the inlet end of the planar surface having the viewing station therein.
Figure 2:
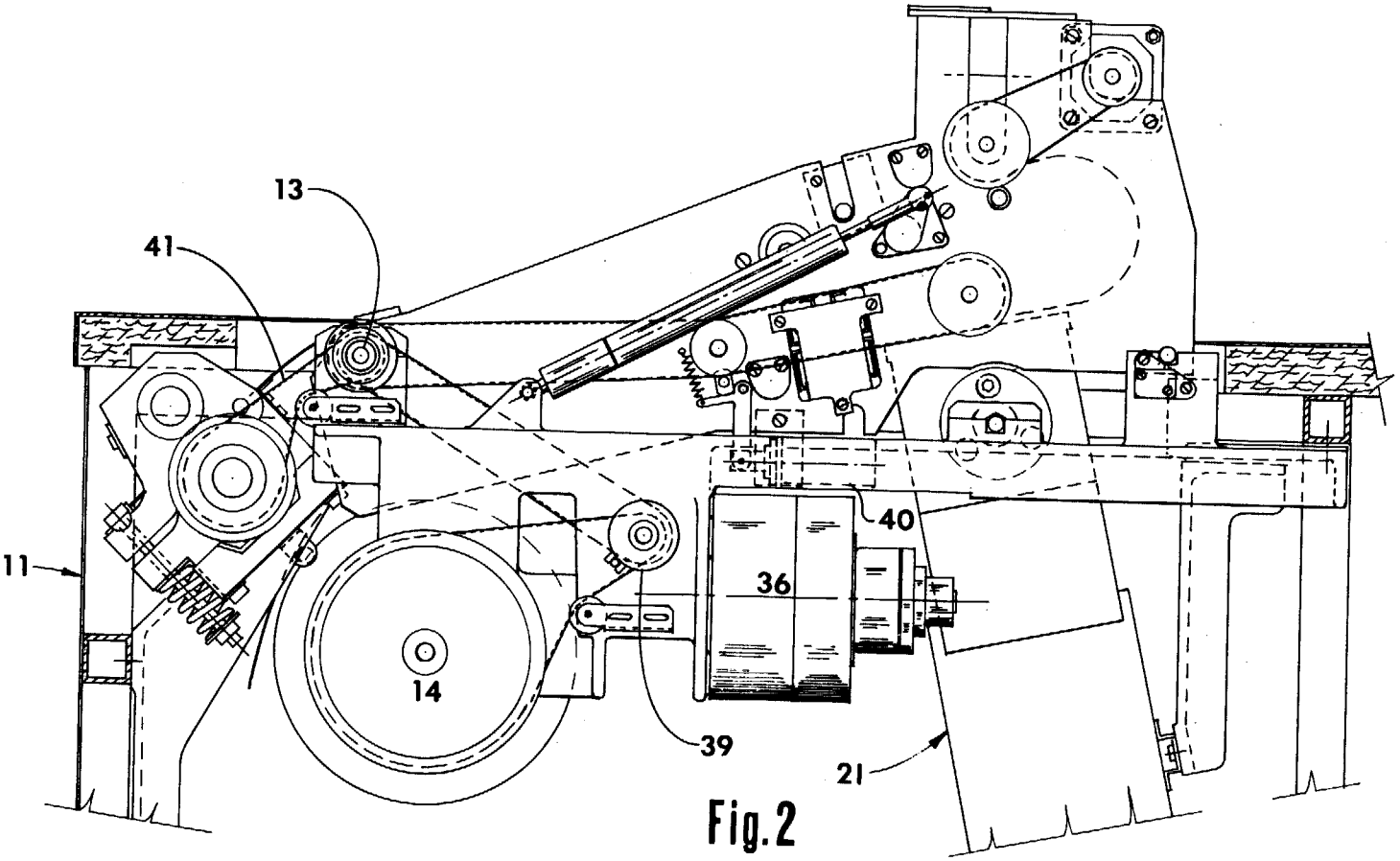
FIG. 2 is a right side elevational view of the apparatus shown in FIG. 1.
Figure 3:
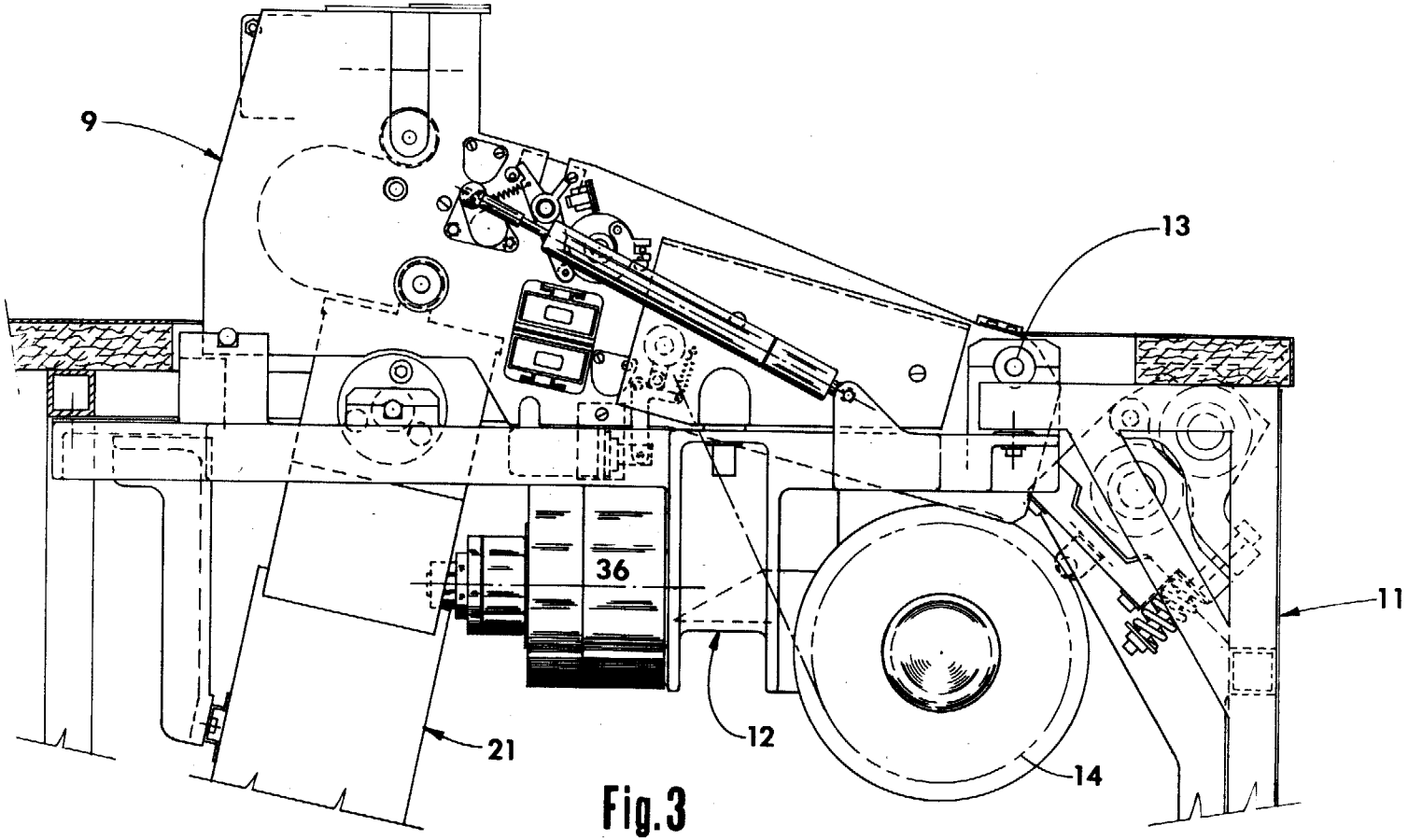
FIG. 3 is a left side elevational view of the apparatus shown in FIG. 1.
Figure 4:
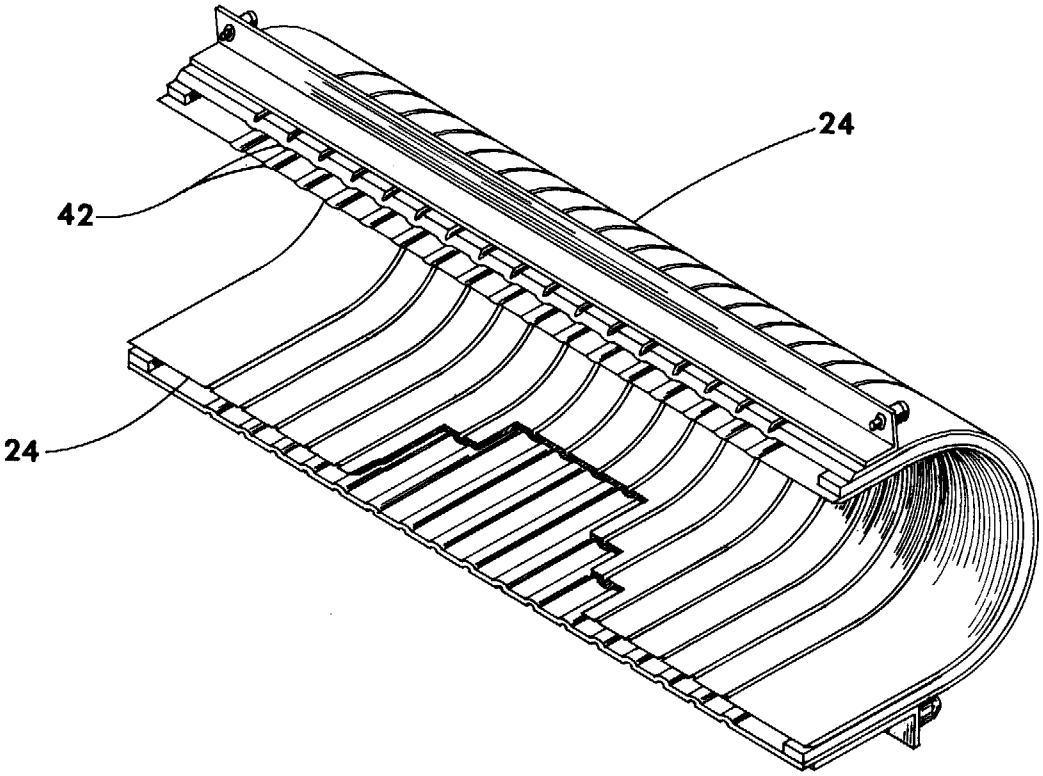
FIG. 4 is a perspective view of the improved curvilinear guide means for use in the transport system in accordance with the present invention partly broken away to show the guide ribs for guiding the electrostatic strip material therethrough.

Referring now to the drawings in detail, the electrostatic feed assembly is a part of an information retrieval system that enables the production of hard copies of information retrieved by the system. Mounted on the housing 11 for the system, there is a main support frame 12 upon which the elements of the strip feed assembly 9 are mounted. The strip feed assembly 9 is mounted on the main support frame 12 on a shaft 13. The strip feed assembly 9 may be pivoted from a general horizontal position to a vertical position so that a supply roll 14 may be mounted on the main support frame 12 at the bottom thereof. The supply roll 14 is the source of electrostatic strip material 15 such as paper. The supply roll 14 is freely rotatable to unspool a strip of electrostatic material 15, and is also driveable only in reverse when the strip of electrostatic material 15 is recalled for erasure and reuse. The strip 15 from the supply roll 14 is led to a pair of feed rollers 16, 16 which are necessary to feed the electrostatic strip 15 since the supply roll is not driven for unspooling, but only in reverse for purposes of recall. Immediately past the feed rollers 16, 16, there is mounted a conditioning lamp 17 before which, the electrostatic strip 15 passes to be given a pre-imaging condition. The position of the electrostatic strip is maintained by top and bottom horizontal planar guides 18 which conduct the electrostatic strip 15 past the conditioning lamp 17. The virgin electrostatic strip, by exposure to the conditioning lamp 17, is brought to a condition the same as it would have been if it were recalled from the viewing station as hereinafter referred to, and the toned, unfused electrostatic image thereon was neutralized and erased.

From the conditioning lamp 17, the horizontal planar guides 18 conduct the electrostatic strip 15 between a pair of opposed corona chargers 19, 20 respectively a positive charger 19 on one side and a negative charger 20 on the other side. From the chargers 19, 20, the horizontal planar guides 18 conduct the electrostatic strip 15 past an imaging device 21, having a CRT fiber optic face plate 22, which imparts an image to the strip 15. Many imaging devices are well known and can be used for the purpose of imparting an image to the electrostatic strip. In order to maintain close contact by the electrostatic strip 15 with the face plate 22, there is provided immediately opposite the imaging device, a shaft 10 mounted on bearings at each end; the shaft carries a roller 23 of conductive foam elastomer which is inherently resiliently compressible and maintains the electrostatic strip 15 in close engagement with the imaging device face plate 22. The conductive roller 23 bleeds off any charge freed by the imaging process which might impair the image. The roller 23 rotates at a faster relative speed than the strip 15 moves. This means that the strip 15 passes freely over the face plate 22. Instead of the imaging device referred to, other imaging devices such as lasers or electron beam means can be used to provide an electrostatic image. After imaging, the electrostatic strip 15 is direction-reversed by conducting it between a pair of curvilinear reversing guides 24, 24. These curvilinear reversing guides 24, 24 are made of non-conductive material so as not to impair the electrostatic charge on the strip 15. The charged strip 15 tends normally to stall as it passes between the curvilinear reversing guides by reason of the interface attraction between the charged electrostatic strip 15 and curvilinear reversing guides 24, 24. This stalling of the electrostatic strip 15 as it moves between the reversing curvilinear guides 24, 24 is avoided by providing the guides 24, 24 with pairs of opposed longitudinal ribs 42, 42 sufficient to permit the electrostatic strip 15 to pass between them with only minimal contact with the apexes of the longitudinal ribs 42, 42. By avoiding complete interface contact between the electrostatic strip 15 and the entire surface of the curvilinear reversing guides 24, 24, the attraction of the strip 15 to the curvilinear reversing guides 24, 24 is drastically reduced and the strip moves freely toward the toner 25. Upon emerging from the curvilinear reversing guides 24, 24, the strip 15 passes the toner 25 which dispenses toner powder from the surface of a roller 36 upon which the toner powder is spread. The toner powder is attracted to the electrostatically charged image on the strip as the strip comes in contact with the toner dispensing roller 36. This toner 25 is of the magnetic type so that it can perform not only the toning function by applying toner powder to the electrostatic image, but also a detoning function if the strip 15 is reversed and the electrostatic image thereon is neutralized before reaching the toner 25. Immediately past the toner, there is mounted a normally inactive lamp 27 which operates only when the strip feed assembly is operated in reverse mode, to pull back the toned, unfused electrostatic strip from the viewing station as will hereinafter be referred to.

Immediately past the neutralizing lamp 27, there is a rotary cutter knife 28 that is operated at the election of the user when he elects to make a hard copy. The forward movement of the electrostatic strip 15 after it leaves the toner is accomplished by three pairs of transfer rollers 37, each pair of which carries a belt 29 with a plurality of longitudinal slots (not shown). The belts 29 ride on the rollers 37 over a slotted plenum 31 from which a fan 32 exhausts the air, thereby causing the electrostatic strip 15 to follow the belts 29 toward the discharge end of the strip feed assembly by a partial vacuum created by the fan 32. In the area on both the front side and the back side of the rotary cutter 28, a plurality of apertures communicating with the plenum 31 maintain the electrostatic strip 15 flat for precise cutting by the rotary cutter knife 28. The belts 29 define a viewing station 34 extending generally between the transfer rollers 37, 37 where the toned, unfused electrostatic image may be viewed. Since electrostatic images on electrostatic strips 15 are discharged under ambient light during the viewing process, the toned, the unfused electrostatic image will be discharged dependent upon the amount of ambient light exposure. Thus if the viewing station 34 exposes a lengthy fine print text which is time consuming to read, the unfused, toned electrostatic image may be exposed to ambient light for a long period of time sufficient to enable it to be read and sufficient to totally neutralize the electrostatic charge. It is an important feature of this invention that the viewing station 34 is disposed in a nearly horizontal plane to avoid the disturbance of the toner powder on the site of the electrostatic image if the operator chooses to fuse it on the electrostatic strip 15. Therefore, a cold pressure fuser 35 is placed in close proximity to the transfer belts 29. When the transfer belts are actuated to move the electrostatic strip 15 with the toned, unfused image thereon to the fusers, the movement of the toned, unfused image on the electrostatic strip 15 will not disturb or render the image fuzzy or unsharp. It will pass between the pressure rollers of the fuser 35 which apply pressure and render the image permanent. At the same time that the transfer belts commence to move to deliver the electrostatic strip to the fuser 35, the rotary cutter knife 28 severs the elected portion of the electrostatic strip 15 from the strip attached to the paper supply roll 14. Simultaneously, the paper supply roll 14 which previously had been freely rotatable for unspooling the electrostatic strip 15, is now driven in reverse by the motor 36 to withdraw the electrostatic strip's 15 leading edge from the rotary knife cutter 28 back to the feed rollers 16, 16 where it is stopped and ready for the next successive cycle. In so moving, the electrostatic strip 15 withdrawn from the rotary cutter knife 28 and is once more ready for imaging.

If the electrostatic strip 15 at the viewing station 34 discloses information which is not useful, the reverse drive motor 36 drives the paper supply roll 14 in reverse mode and carries the toned, unfused electrostatic image back past the erase lamp 27 and the toner 25 magnetically removes the toner powder which is no longer electrostatically held. The paper supply roll 14 which only is driven in the reverse mode, carries the electrostatic strip 15 back to the feed rollers 16, 16 and it is once more ready for reimaging. The neutralizing lamp 27 is concurrently activated with the reverse motor 36, and neutralizes a rejected electrostatic image for detoning by the magnetic toner 25 and for reuse of the strip 15.

The fuser 35 is driven at the election of the operator to draw the electrostatic strip 15 into the nip of the rollers 7, 7 to apply pressure to render the image permanent. The fuser 35 assembly is a pair of rollers 7,7 and accomplishes the fusing of the toned, unfused electrostatic image on the electrostatic strip 15 by pressure alone. While the present apparatus utilizes pressure only to fuse, it is to be understood that heat may also be used to fuse. When the fuser 35 is activated, a motor and belt not shown drive the pressure rollers. Another belt 41 driven from the pressure rollers 7,7 simultaneously drives the transport belts 29 to deliver the severed imaged strip to the pressure rollers 7,7. Further, thus if the electrostatic strip 15 is to be discarded and withdrawn from the viewing station 34 toward the paper supply roll 14, the transfer rollers 37, 37 do not operate. It is the operation of the supply roll 14 in reverse mode that withdraws the strip 15 for reuse. The feed rollers 16, 16 are spread and rendered inoperative by the solenoid 40 only when the supply roll 14 is driven in reverse mode to recapture a discarded portion of the strip 15.

The reversing of the paper supply roll 14, ordinarily freely rotatable, is required when the apparatus goes into rewinding-mode to return the electrostatic strip 15 which has been fed, or at least a portion of it. This is accomplished by a clutch 39 which connects a drive motor 36 to the supply roll 14. Since the feed rollers 16, 16 are gripping the strip 15 for forward feeding, a solenoid 40 retracts the lower feed roller so that the electrostatic strip 15 momentarily is no longer held and may be recalled and rewound on the supply roll 14.

The opening of the rollers 16, 16 and the pull of the driven paper supply roll 14 has a further advantage of straightening the strip 15 to make it more acceptable for reuse.

What is claimed:

1. An apparatus for forming, toning and displaying the unfused visible electrostatic image on an electrostatic strip, and alternatively and selectively for erasing the electrostatic's image to permit reuse of the electrostatic strip or for fusing the visible electrostatic image to make a permanent copy thereof includes, a. frame means, b. a roll of electrostatic strip material rotatably mounted in said frame for providing a source of electrostatic strip material for use in the apparatus, c. a generally planar surface means on said frame a predetermined spaced distance from said roll of electrostatic strip material having, a viewing station therein, an inlet end at one end of said viewing station, and an outlet end remote from the inlet end to permit an electrostatic strip to be fed across the viewing station in said planar surface means, d. means to feed said electrostatic strip material from the roll or to rewind the same on said roll, and e. non-conductive curvilinear reversing guide means mounted in said frame for operative coaction with the feeding and rewinding means and disposed to permit the electrostatic strip to move in one direction into the inlet end of the planar surface means and in the opposite direction to return through the curvilinear reversing guide means when the electrostatic strip is rewound on the roll of electrostatic strip material, f. said reversing guide means including, i. spaced guide members defining an electrostatic strip passage therebetween, and ii. a plurality of longitudinal ribs on the respective opposed faces of the guide members operatively associated for guiding the electrostatic strip between the guide members to and away from the inlet end of the planar surface means whereby the electrostatic strip is prevented from jamming as it moves through the spaced guide members.

2. The apparatus as claimed in claim 1 wherein said longitudinal ribs are in opposed alignment with each other and are spaced to hold the electrostatic strip from contact with the adjacent surface of the respective guide members of the curvilinear reversing guide.

3. A curvilinear reversing guide for a transport system for strip material comprising, a. a curved inner guide member, and a curved outer guide member connected in spaced relation to each other to form a passage therebetween for the strip material, b. means on the respective opposed faces of the curved inner guide member and outer guide member to maintain the strip material from contact with the respective opposed faces of the inner guide member and outer guide member.

4. In the curvilinear reversing guide as claimed in claim 3 wherein the means for holding the strip material consists of a plurality of spaced longitudinally extending ribs disposed respectively on the opposed faces of the inner guide member and outer guide member.

5. In the curvilinear reversing guide assembly as claimed in claim 4 wherein the longitudinal ribs are spaced and in alignment with each other.

* * * * *